US011850860B2

(12) United States Patent
Kawakami et al.

(10) Patent No.: US 11,850,860 B2
(45) Date of Patent: Dec. 26, 2023

(54) CLEANING DEVICE AND IMAGE FORMING APPARATUS

(71) Applicant: Konica Minolta, Inc., Tokyo (JP)

(72) Inventors: Hajime Kawakami, Hino (JP); Hiroaki Umemoto, Neyagawa (JP)

(73) Assignee: KONICA MINOLTA, INC., Tokyo (JP)

( * ) Notice: Subject to any disclaimer, the term of this patent is extended or adjusted under 35 U.S.C. 154(b) by 18 days.

(21) Appl. No.: 17/536,845

(22) Filed: Nov. 29, 2021

(65) Prior Publication Data

US 2022/0176702 A1 Jun. 9, 2022

(30) Foreign Application Priority Data

Dec. 4, 2020 (JP) ..... 2020-201914

(51) Int. Cl.
*B41J 2/165* (2006.01)

(52) U.S. Cl.
CPC ..... *B41J 2/16552* (2013.01); *B41J 2/16535* (2013.01); *B41J 2/16538* (2013.01); *B41J 2002/16558* (2013.01)

(58) Field of Classification Search
CPC ..... B41J 2/16552; B41J 2/16535; B41J 2002/16558; B41J 2/16538
See application file for complete search history.

(56) References Cited

U.S. PATENT DOCUMENTS

2009/0219335 A1* 9/2009 Furukawa ..... B41J 2/16552 347/33
2016/0361927 A1* 12/2016 Berrios ..... B41J 2/16552

FOREIGN PATENT DOCUMENTS

JP 2009286077 A * 12/2009
JP 2020-082687 A 6/2020

* cited by examiner

*Primary Examiner* — Sharon Polk
(74) *Attorney, Agent, or Firm* — LUCAS & MERCANTI, LLP

(57) ABSTRACT

A cleaning device includes a plurality of cleaning members that come into contact with an ejection surface of a droplet ejector that ejects droplets to clean the ejection surface, in which the plurality of cleaning members are in a wet state.

17 Claims, 9 Drawing Sheets

CLEANING DEVICE AND IMAGE FORMING APPARATUS

The entire disclosure of Japanese patent Application No. 2020-201914, filed on Dec. 4, 2020, is incorporated herein by reference in its entirety.

BACKGROUND

Technological Field

The present invention relates to a cleaning device and an image forming apparatus.

Description of the Related Art

In an image forming apparatus that ejects droplets onto a recording medium to form an image, if the droplets are fixed on an ejection surface of a droplet ejector that ejects the droplets, the performance for ejecting the droplets is affected, and thus a technique for cleaning the ejection surface with a cleaning member in a wet state is conventionally known.

For example, JP 2020-82687 A discloses a configuration that includes a first contact member wetted with wetting liquid and a second contact member drier than the first contact member and in which the first contact member and the second contact member come into contact with an ejection surface and wipe the ejection surface to reduce unwiped portions of the ejection surface.

However, in the configuration described in JP 2020-82687 A, when matter absorbed by the contact members wiping the ejection surface is dried and fixed, cleaning the ejection surface with the contact members containing the absorbed and fixed matter (fixed matter) may damage the ejection surface with the fixed matter. When the ejection surface is damaged, an ejection portion (nozzle) may be chipped and the ejection performance may be deteriorated, or the cleaning performance may be deteriorated due to the deterioration or the like of the ejection surface.

SUMMARY

An object of the present invention is to provide a cleaning device and an image forming apparatus capable of preventing an ejection surface from being damaged due to fixing of matter absorbed by cleaning members.

To achieve the abovementioned object, according to an aspect of the present invention, a cleaning device reflecting one aspect of the present invention comprises a plurality of cleaning members that cone into contact with an ejection surface of a droplet ejector that ejects droplets to clean the ejection surface, wherein the plurality of cleaning members are in a wet state.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
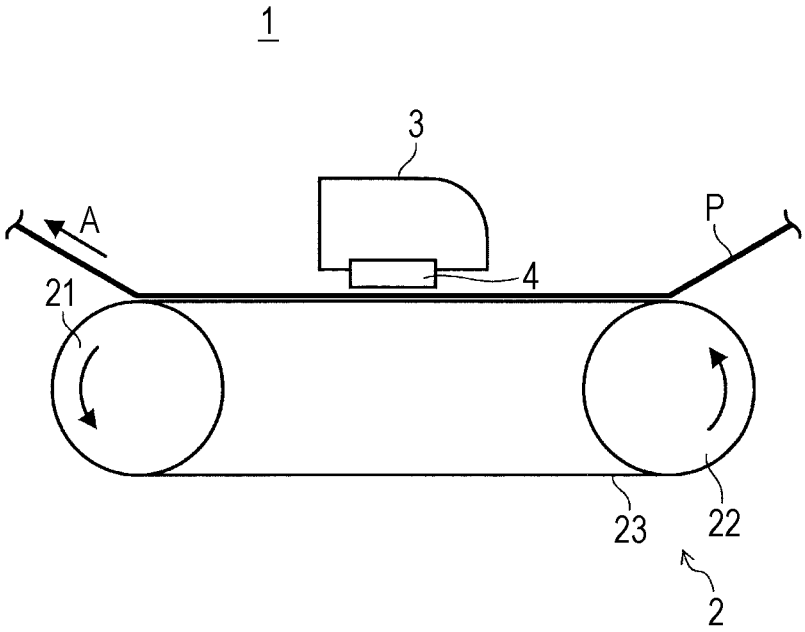
FIG. 1 is a diagram schematically illustrating an overall configuration of an image forming apparatus according to an embodiment of the present invention.

Hereinafter, one or more embodiments of the present invention will be described with reference to the drawings. However, the scope of the invention is not limited to the disclosed embodiments. FIG. 1 is a diagram illustrating a schematic configuration of an image forming apparatus 1 according to the embodiment of the present invention.

As illustrated in FIG. 1, the image forming apparatus 1 is an inkjet type image forming apparatus, and includes a belt conveyance device 2, a recording head 3, a cleaning device 4, and the like.

In the belt conveyance device 2, an endless conveyance belt 23 having a predetermined width is stretched over a driving roller 21 and a driven roller 22 disposed in parallel at a predetermined interval. An upper surface of the conveyance belt 23 stretched over the driving roller 21 and the driven roller 22 is a placement surface on which a recording medium P is closely placed.

Note that an adhesive for bringing the recording medium P being conveyed into close contact with the upper surface of the conveyance belt 23 is applied to the surface of the conveyance belt 23. The driving roller 21 is driven by a sub-scanning motor (not illustrated).

In the belt conveyance device 2, the driving roller 21 is rotated at a predetermined speed in a counterclockwise direction (see an arrow) in FIG. 1 by a rotational drive of the sub-scanning motor, thereby rotationally moving the conveyance belt 23 stretched between the driving roller 21 and the driven roller 22. With this operation, the recording medium P placed on the upper surface of the conveyance belt 23 is conveyed in a direction of an arrow A in the drawing, which is a sub-scanning direction.

As the recording medium P for example, a recording medium usually used for inkjet recording, such as paper, fabric, a plastic film, or a glass plate, can be used. The recording medium P may have a sheet shape cut into a predetermined size, or may have an elongated shape continuously fed from an original roll wound in a roll shape.

Note that a belt cleaning device (not illustrated) is provided on the side opposite to a conveyance surface of the belt conveyance device 2, on which the recording medium P is conveyed. This bell cleaning device removes foreign matter adhering to the conveyance belt 23.

The recording head 3 includes a plurality of recording elements (inkjet heads), and is disposed above the surface of the conveyance belt 23, on which the recording medium P is placed, at a predetermined interval. The recording head 3 ejects ink droplets (droplets) from an ejection surface 3A of each of a large number of nozzles provided on a lower surface of the recording head 3, thereby recording a desired image on the recording medium P conveyed by the rotational movement of the conveyance belt 23. The recording head 3 corresponds to a "droplet ejector" of the present invention.

In the present embodiment, the recording head 3 is a line-type recording head that is fixedly bridged over a width direction of the conveyance belt 23 and ejects the ink droplets onto the recording medium P, which is continuously conveyed, to record an image. In this case, at the time of recording, the driving of the driving roller 21 is controlled such that the conveyance belt 23 moves (rotates) continuously.

Note that the recording head 3 may be a shuttle type recording head that is mounted on a carriage (not illustrated) and reciprocates in a main scanning direction orthogonal to a conveyance direction of the recording medium P, which is intermittently conveyed. In this case, at the time of recording, the driving of the driving roller 21 is controlled such that the conveyance belt 23 performs an intermittent operation in which a standby state and a driving state are repeated.

Figure 3:
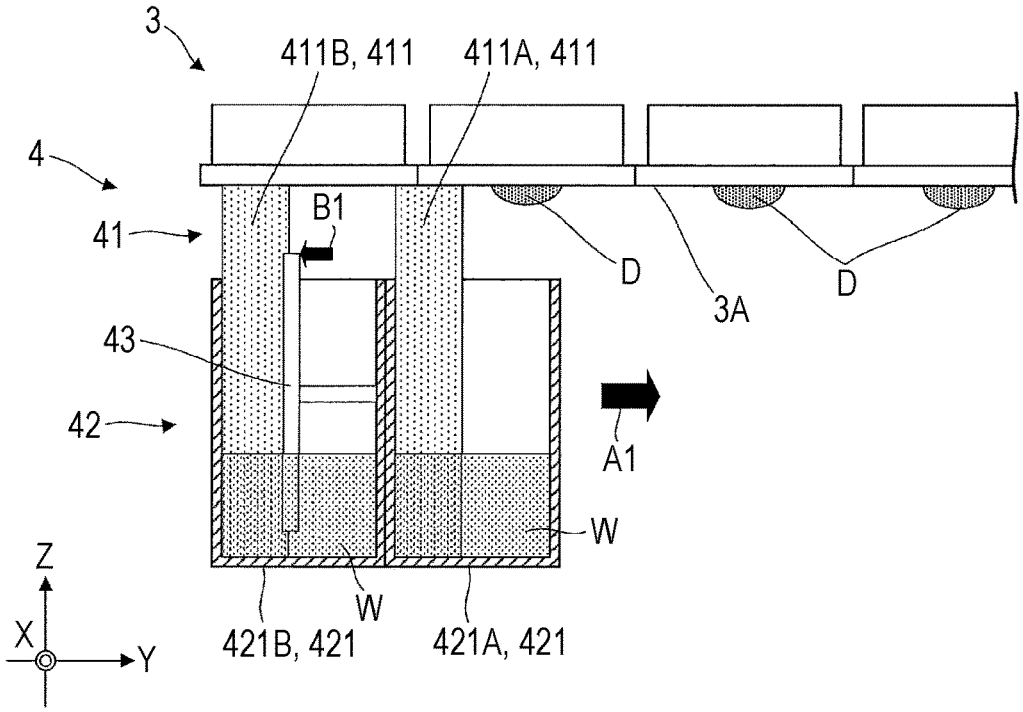
FIG. 3 is a diagram illustrating a configuration of a cleaning device.

The cleaning device 4 is a device that cleans the ejection surface 3A of the recording head 3 that ejects the ink droplets, and includes a cleaner 41, a fixing preventer 42, and an adjuster 43 (see FIG. 3). The cleaning device 4 is disposed at a position different from a position corresponding to the ejection surface 3A of the recording head 3 at the time of image formation. Note that, in FIG. 1, an example is illustrated in which the cleaning device 4 is disposed outside a position corresponding to the recording head 3 in the width direction of the conveyance belt 23. Details of the cleaning device 4 will be described later.

Figure 2:
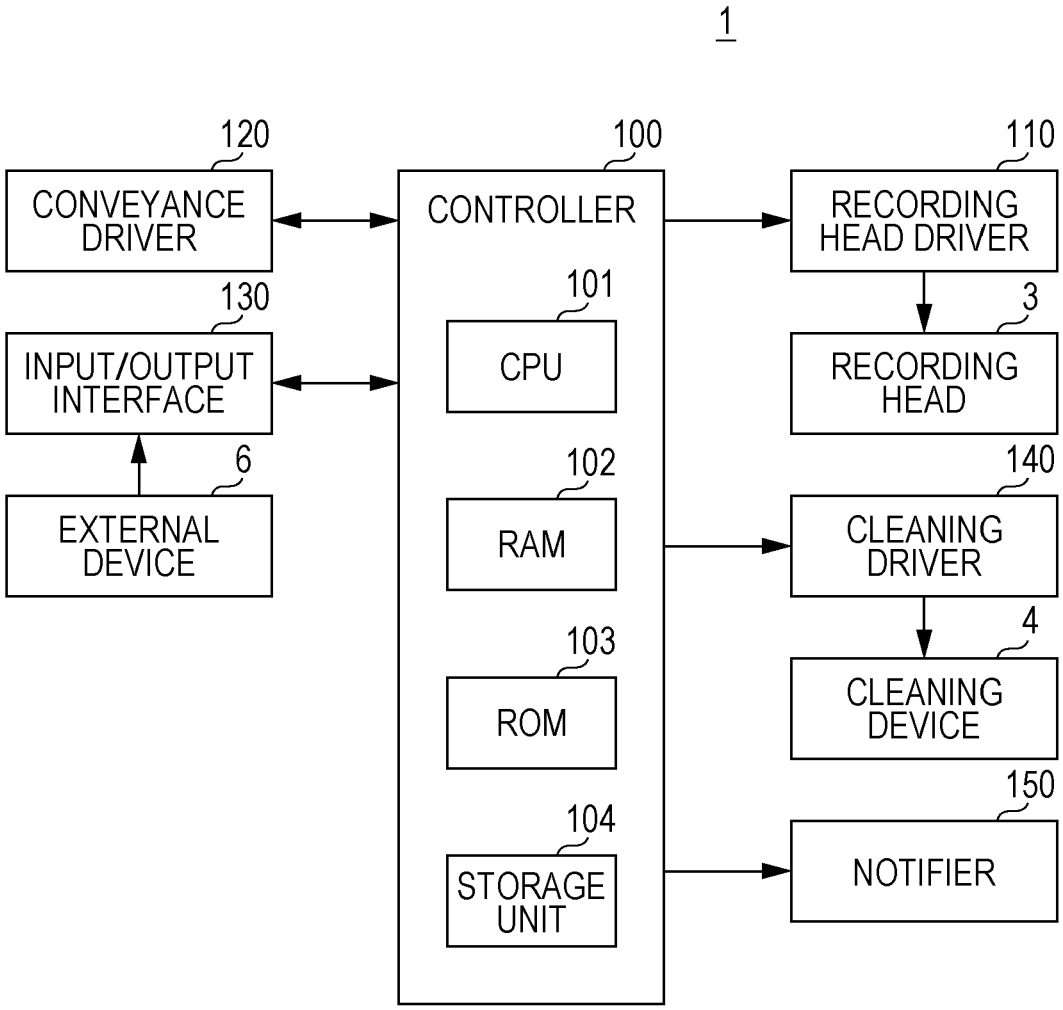
FIG. 2 is a diagram illustrating a main part of a control system of the image forming apparatus according to the present embodiment.

FIG. 2 is a block diagram illustrating a main functional configuration of the image forming apparatus 1. The image forming apparatus 1 includes a controller 100, a recording head driver 110, a conveyance driver 120, an input/output interface 130, a cleaning driver 140, and a notifier 150.

The controller 100 includes a central processing unit (CPU) 101, a random access memory (RAM) 102, a read only memory (ROM) 103, and a storage unit 104.

The CPU 101 reads various control programs and setting data stored in the ROM 103, stores the programs in the RAM 102, and executes the programs to perform various arithmetic processing. In addition, the CPU 101 integrally controls the entire operation of the image forming apparatus 1.

The RAM 102 provides the CPU 101 with a working memory space and stores temporary data. Note that the RAM 102 may include a nonvolatile memory.

The ROM 103 stores the various control programs executed by the CPU 101, the setting data, and the like. Note that, instead of the ROM 103, a rewritable nonvolatile memory such as an electrically erasable programmable read only memory (EEPROM) or a flash memory may be used.

The storage unit 104 stores a print job (image recording command) input from an external device 6 via the input/output interface 130 and image data related to the print job. As the storage unit 104, for example, a hard disk drive (HDD) is used, and a dynamic random access memory (DRAM) or the like may be used in combination.

The recording head driver 110 supplies a drive signal corresponding to the image data to the recording head 3 at an appropriate timing under the control of the controller 100, thereby causing the nozzles of the recording head 3 to eject ink of an amount corresponding to a pixel value of the image data.

The conveyance driver 120 supplies a drive signal to the sub-scanning motor of the driving roller 21 under the control of the controller 100, thereby rotationally moving the conveyance belt 23 at a predetermined speed and a predetermined timing.

The input/output interface 130 mediates transmission and reception of data between the external device 6 and the controller 100. The input/output interface 130 includes, for example, any of various serial interfaces and various parallel interfaces, or a combination thereof.

The external device 6 is, for example, a personal computer, and supplies the image recording command (print job), the image data, and the like to the controller 100 via the input/output interface 130.

The cleaning driver 140 supplies, for example, a drive signal to the cleaning device 4 under the control of the controller 100, thereby moving the cleaning device 4.

The notifier 150 is a unit capable of notifying a user of predetermined information, such as a display unit or a voice output unit of the image forming apparatus 1.

Next, details of the cleaning device 4 will be described. FIG. 3 is a diagram illustrating a configuration of the cleaning device 4. Note that an orthogonal coordinate system (X, Y, Z) is used to describe the structure of the cleaning device 4 of the present embodiment. Also in the drawings described later, the common orthogonal coordinate system (X, Y, Z) is used. For example, in FIG. 3 and the like, a depth direction of a paper surface is an X direction, a horizontal direction of the paper surface is a Y direction, and a vertical direction of the paper surface is a Z direction.

As illustrated in FIG. 3, the cleaning device 4 includes the cleaner 41, the fixing preventer 42, and the adjuster 43, as described above, and is configured to be relatively movable with respect to the ejection surface 3A of the recording head 3 in the Y direction (predetermined direction). For example, the cleaning device 4 is provided at a position corresponding to an end portion of the recording head 3 in the Y direction at the time of cleaning the ejection surface 3A, and performs cleaning to wipe off ink droplets D adhering to the ejection surface 3A by relatively moving in the Y direction.

Note that the cleaning device 4 may clean the ejection surface 3A by moving in the Y direction or by the recording head 3 moving in the Y direction. Furthermore, when the recording head 3 is configured to be immovable, for example, the belt conveyance device 2 is configured to retreat from a region where the cleaning device 4 can move so as to ensure the region. Furthermore, when the recording head 3 is configured to be movable, for example, the cleaning device 4 is disposed at a position different from the belt conveyance device 2 in the Y direction, and the recording head 3 is configured to move to a position corresponding to the cleaning device 4. In addition, the Y direction can be an appropriate direction such as the conveyance direction of the conveyance belt 23 or the width direction of the conveyance belt 23.

The cleaner 41 includes a first cleaning member 411A and a second cleaning member 411B (a plurality of cleaning members 411) that clean the ink droplets D (droplets) on the ejection surface 3A of the recording head 3. Note that, in the following description, the first cleaning member 411A and the second cleaning member 411B will be simply referred to as a cleaning member 411 unless otherwise distinguished.

Each of the plurality of cleaning members 411 is an elastic member (for example, sponge or the like) capable of absorbing the ink droplets D (liquid), and includes a blade member extending in a vertical direction. The plurality of cleaning members 411 are disposed so as to be contactable with the ejection surface 3A of the recording head 3 at their upper end portions, and are arranged side by side in the Y direction.

The first cleaning member 411A is disposed at a position closer to the recording head 3 than the second cleaning member 411B at the start of cleaning the cleaning device 4. In other words, the second cleaning member 411B is disposed on the downstream side of the first cleaning member 411A in a direction in which the cleaning device 4 relatively moves (hereinafter, referred to as a moving direction (see an arrow A1)). The first cleaning member 411A corresponds to an "upstream cleaning member" of the present invention, and the second cleaning member 411B corresponds to a "downstream cleaning member" of the present invention.

The fixing preventer 42 is for preventing matter absorbed from the ejection surface 3A by the plurality of cleaning members 411 from being fixed in the cleaning members 411, and includes a storage 421 that stores wetting liquid W for bringing the plurality of cleaning members 411 into a wet state. The wetting liquid W may be any liquid such as pure water as long as the liquid can clean the ejection surface 3A.

The plurality of cleaning members 411 are disposed such that their lower end portions are positioned in the storage 421, and are immersed in the wetting liquid W in the storage 421. As a result, the plurality of cleaning members 411 are in the wet state. That is, the fixing preventer 42 is configured to always keep the plurality of cleaning members 411 in the wet state.

As described above, the plurality of cleaning members 411 are kept in the wet state, so that it is possible to prevent the matter (ink droplets) absorbed by the cleaning members 411 from being dried and fixed when the cleaning members 411 wipe off the ink droplets D adhering to the ejection surface 3A.

The storage 421 includes a first storage 421A and a second storage 421B. The first storage 421A is a storage for bringing the first cleaning member 411A into the wet state, and is disposed corresponding to the first cleaning member 411A. The second storage 421B is a storage for bringing the second cleaning member 411B into the wet state, and is disposed corresponding to the second cleaning member 411B.

Note that, when the cleaning device 4 is configured to move, each of the cleaning members 411 may be fixed in the storage 421 and the storage 421 may be configured to move. Furthermore, when the recording head 3 is configured to move, each of the cleaning members 411 may be fixed at an appropriate position, such as in the storage 421.

The adjuster 43 adjusts the water content of the cleaning member 411 in the wet state to be smaller than the water content of the cleaning member 411 before the adjustment, and is disposed in the second storage 421B. The adjuster 43 includes a pressing member configured to press the second cleaning member 411B toward a side wall of the second storage 421B.

Specifically, for example, the adjuster 43 includes a plate-like member parallel to a surface of the cleaning member 411 in the Z direction, and is configured to be able to press the cleaning member 411 by moving in the Y direction (see an arrow B1).

The adjuster 43 is configured to press the second cleaning member 411B against the side wall of the second storage 421B to squeeze out liquid contained in the second cleaning member 411B, so that it is possible to adjust the water content of the second cleaning member 411B for reducing the water content. That is, the adjuster 43 is configured to be able to make the water content of the second cleaning member 411B smaller than the water content of the first cleaning member 411A. Note that the adjuster 43 may have any configuration as long as the water content of the cleaning member 411 can be adjusted.

The adjuster 43 is configured to be able to set an adjustment amount (reduction amount) of the water content of the second cleaning member 411B according to a cleaning type of the recording head 3. The adjuster 43 automatically sets the adjustment amount under the control of the controller 100. Note that the adjustment amount may be set by an operation of the user.

For example, the adjuster 43 sets the adjustment amount so as to make the water content smaller in cleaning after a purge is performed for recovering chipping or bending of the nozzles of the recording head 3. Since the purge forcibly ejects the ink droplets from the nozzles of the recording head 3, the liquid ink droplets increase on the ejection surface 3A after the purge is performed. Therefore, in this case, the ink droplets are more easily absorbed by the cleaning member 411 having a smaller water content wiping the ejection surface 3A.

In the present embodiment, in this case, the adjustment amount is set such that the water content of the second cleaning member 411B is made smaller, whereby the second cleaning member 411B can reliably absorb the ink droplets on the ejection surface 3A wiped by the first cleaning member 411A while the wet state of the second cleaning member 411B is maintained.

Furthermore, in cleaning for removing ink droplets fixed on the recording head 3, the adjuster 43 sets the adjustment amount such that the water content of the second cleaning member 411B is made larger. Specifically, for example, the adjuster 43 sets the adjustment amount to zero and releases the pressing to the second cleaning member 411B such that the second cleaning member 411B is brought into a sufficiently wet state.

With such an operation, the ejection surface 3A is cleaned by the plurality of cleaning members 411 in the sufficiently wet state, so that the fixed ink droplets can be easily removed.

Figure 4:
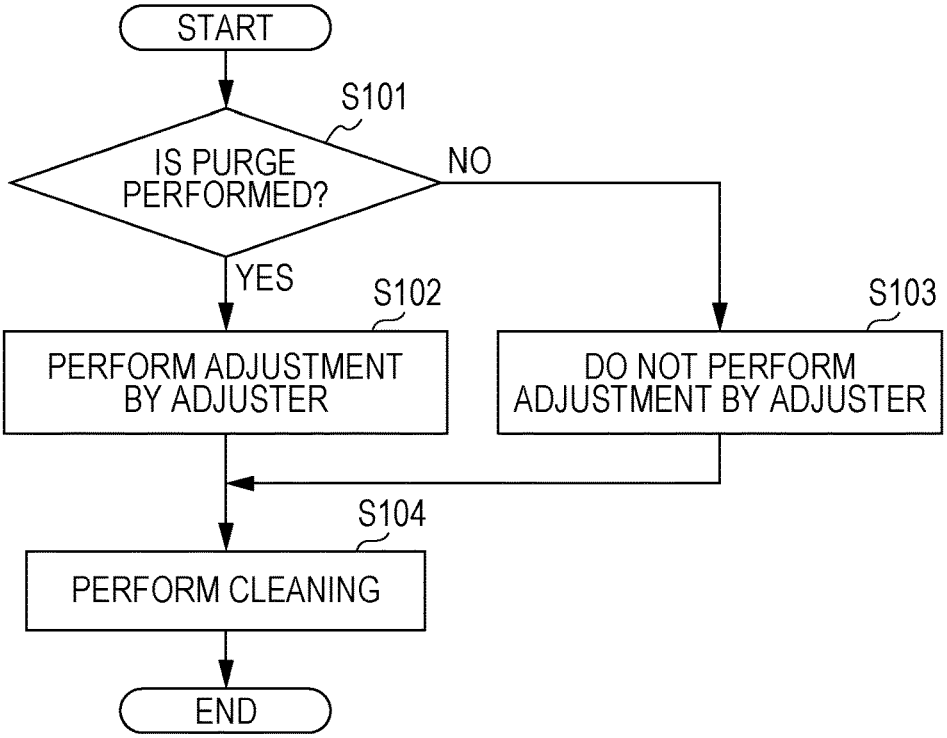
FIG. 4 is a flowchart illustrating an operation example of cleaning control of the cleaning device in the image forming apparatus.

An operation example of cleaning control of the cleaning device 4 in the image forming apparatus 1 configured as described above will be described. FIG. 4 is a flowchart illustrating the operation example of the cleaning control of the cleaning device 4 in the image forming apparatus 1. The processing in FIG. 4 is appropriately executed, for example, when the image forming apparatus 1 receives an execution command of the cleaning control.

As illustrated in FIG. 4, the controller 100 determines whether this control is cleaning control after the purge is performed (step S101). As a result of the determination, if this control is the cleaning control after the purge is performed (YES in step S101), the controller 100 adjusts the water content by the adjuster 43 (step S102).

On the other hand, if this control is not the cleaning control after the purge is performed (NO in step S101), the controller 100 does not adjust the water content by the adjuster 43 (step S103). After step S102 or step S103, the controller 100 performs cleaning by the cleaning device 4 (step S104). After step S104, this control ends.

According to the present embodiment configured as described above, the plurality of cleaning members 411 are in the wet state, and thus, the absorbed matter of the ink droplets, which has been wiped off and absorbed from the ejection surface 3A, can be prevented from being fixed.

If the matter absorbed by the cleaning members is fixed, the ejection surface may be damaged by the absorbed matter (fixed matter) when the ejection surface is cleaned by the cleaning members containing the fixed matter.

On the other hand, in the present embodiment, the fixing of the matter absorbed by the cleaning members 411 can be prevented, and thus, it is possible to prevent the ejection surface 3A from being damaged due to the fixing of the absorbed matter. As a result, it is possible to improve the cleaning performance of the cleaning device 4.

Furthermore, the ejection surface 3A is cleaned by the plurality of cleaning members 411, and thus, the ink droplets left unwiped by the first cleaning member 411A can be cleaned by the second cleaning member 411B. As a result, it is possible to improve the cleaning performance of the cleaning device 4.

In addition, the water content of the second cleaning member 411B can be made smaller than the water content of the second cleaning member 411B before the adjustment, and thus can be adjusted according to the cleaning type. As a result, it is possible to perform appropriate cleaning according to the situation, and eventually, it is possible to improve the cleaning performance of the cleaning device 4.

In addition, since the plurality of cleaning members 411 are immersed in the wetting liquid W, the cleaning members 411 are not dried. Therefore, it is possible to reliably prevent the matter absorbed in the cleaning members 411 from being fixed, and eventually, it is possible to improve the cleaning performance of the cleaning device 4.

In addition, since each of the cleaning members 411 includes the blade member, the configuration of the cleaning device 4 can be simplified.

Note that, in the above embodiment, the adjuster 43 can adjust only the water content of the second cleaning member 411B, but the present invention is not limited thereto. For example, as illustrated in FIGS. 5A and 5B, adjusters 43 may be able to adjust all the water contents of the plurality of cleaning members 411.

In this configuration, for example, when the plurality of cleaning members 411 reciprocate between a forward path and a backward path in the Y direction (predetermined direction), it is possible to switch adjustment by the adjusters 43 between cleaning in the forward path and cleaning in the backward path. The forward path is a path in a direction toward the + side in the Y direction (direction of an arrow A1 in FIG. 5A). The backward path is a path in a direction toward the − side in the Y direction (direction of an arrow A2 in FIG. 5B).

Figure 5A:
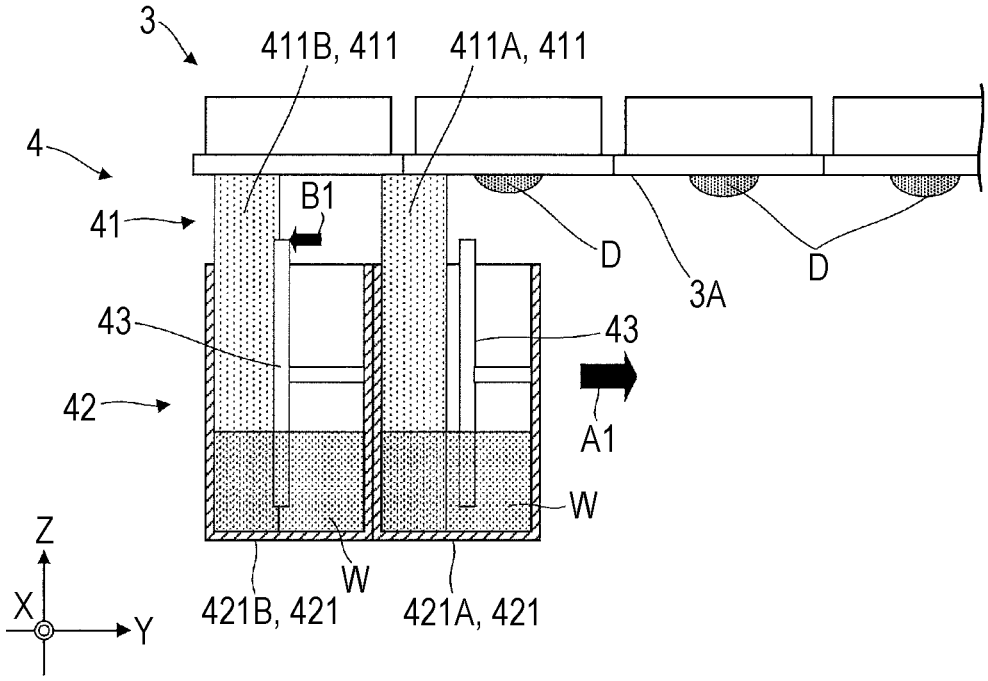
FIG. 5A is a diagram illustrating a configuration of the cleaning device in which an adjuster is provided in each of cleaning members.
Figure 5B:
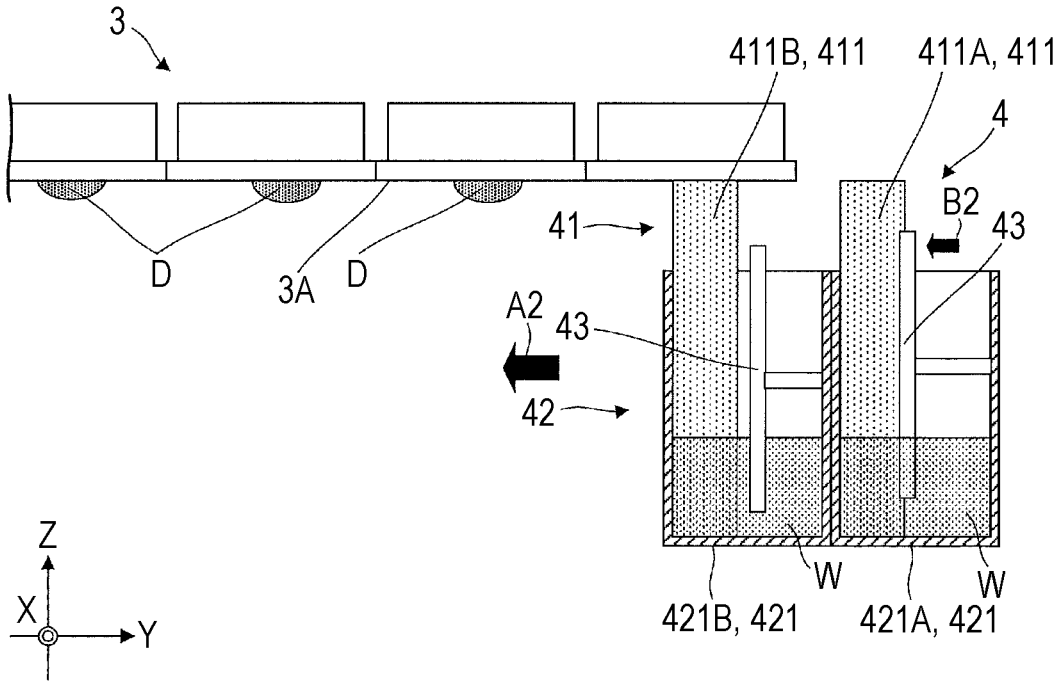
FIG. 5B is a diagram illustrating the configuration of the cleaning device in which the adjuster is provided in each of the cleaning members.

Specifically, as illustrated in FIG. 5A, at the time of cleaning in the forward path, one of the adjusters 43 adjusts the water content of the second cleaning member 411B positioned on the downstream side of the first cleaning member 411A positioned on the upstream side in the moving direction of the cleaning members 411 (see the arrow A1).

That is, the one of the adjusters 43 presses only the second cleaning member 411B (see an arrow B1) to make only the water content of the second cleaning member 411B smaller than the water content of the second cleaning member 411B before the adjustment. The first cleaning member 411A at the time of cleaning in the forward path corresponds to the "upstream cleaning member" of the present invention, and the second cleaning member 411B at the time of cleaning in the forward path corresponds to the "downstream cleaning member" of the present invention.

As illustrated in FIG. 5B, at the time of cleaning in the backward path, one of the adjusters 43 adjusts the water content of the first cleaning member 411A positioned on the downstream side of the second cleaning member 411B positioned on the upstream side in the moving direction of the cleaning members 411 (see the arrow A2).

That is, only the first cleaning member 411A is pressed (see an arrow B2), and only the water content of the first cleaning member 411A is made smaller than the water content of the first cleaning member 411A before the adjustment. The second cleaning member 411B at the time of cleaning in the backward path corresponds to the "upstream cleaning member" of the present invention, and the first cleaning member 411A at the time of cleaning in the backward path corresponds to the "downstream cleaning member" of the present invention.

That is, when the plurality of cleaning members 411 reciprocate between the forward path and the backward path in the Y direction, the adjusters 43 are configured to be able to switch the cleaning member 411 whose water content is made smaller, which is included in the plurality of cleaning members 411, between the forward path and the backward path.

With such a configuration, the states of the water contents of the cleaning members 411 can be made appropriate for the cleaning in the forward path and the cleaning in the backward path.

The water content of the cleaning member 411 positioned on the upstream side in the moving direction may also be adjusted. The cleaning member 411 positioned on the upstream side in the moving direction is the first cleaning member 411A in FIG. 5A, and is the second cleaning member 411B in FIG. 5B. In this case, the water content of the cleaning member 411 may be adjusted to be larger than the water content of the cleaning member 411 positioned on the downstream side of the cleaning member 411.

Furthermore, in the above embodiment, the plurality of cleaning members 411 are contactable with the ejection surface 3A at the time of cleaning, but the present invention is not limited thereto. For example, as illustrated in FIGS. 6A and 6B, at least a part of the plurality of cleaning members 411 may be configured to be able to transition between a contact state in which at least a part of the plurality of cleaning members 411 is contactable with the ejection surface 3A and a non-contact state in which at least a part of the plurality of cleaning members 411 is not contactable with the ejection surface 3A.

Figure 6A:
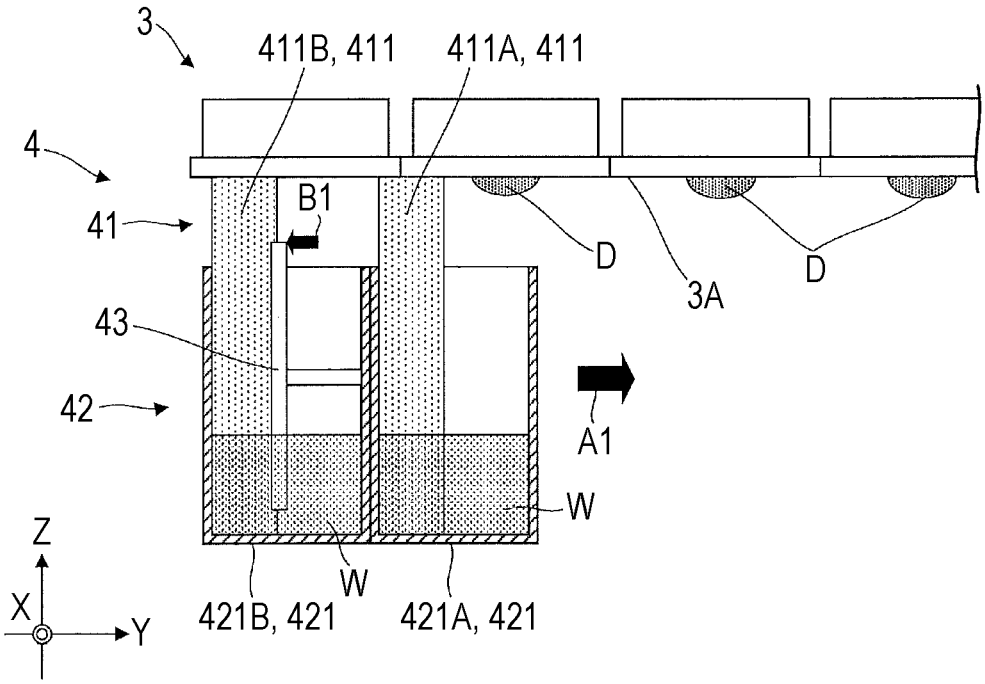
FIG. 6A is a diagram illustrating a configuration of the cleaning device provided with a first cleaning member capable of transitioning between a contact state and a non-contact state.
Figure 6B:
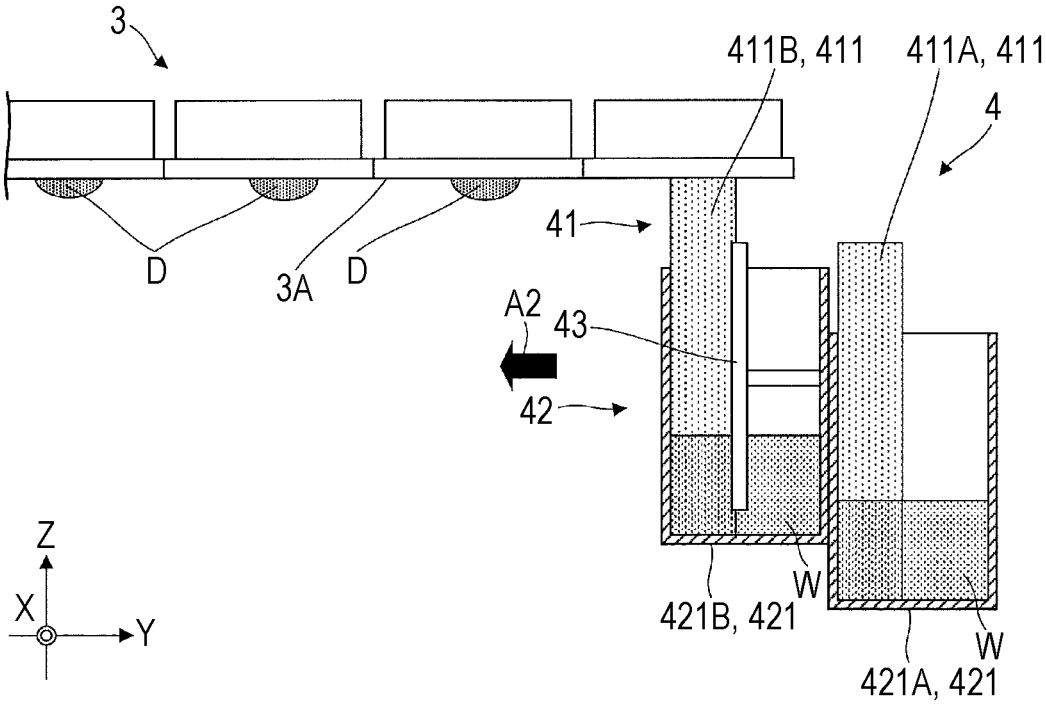
FIG. 6B is a diagram illustrating the configuration of the cleaning device provided with the first cleaning member capable of transitioning between the contact state and the non-contact state.

For example, in the configuration illustrated in FIGS. 6A and 6B, the first cleaning member 411A is configured to be able to transition between the contact state and the noncontact state. In this configuration, the first storage 421A is configured to be movable forward and backward with respect to the ejection surface 3A. Specifically, the first storage 421A is configured to be able to transition between a first position (position illustrated in FIG. 6A) where the first cleaning member 411A is in the contact state and a second position (position illustrated in FIG. 6B) where the first cleaning member 411A is in the non-contact state.

The second position is, for example, a position retracted downward from the ejection surface 3A with respect to the first position. As a mechanism in which the first storage 421A moves forward and backward, a known technique can be used. Note that, in the configuration illustrated in FIGS. 6A and 6B, the adjuster 43 is provided at a position corresponding to the second cleaning member 411B.

With such a configuration, for example, when the plurality of cleaning members 411 reciprocate between the forward path and the backward path in the Y direction, the first cleaning member 411A can be switched between the contact state and the non-contact state according to the movement in the forward path and the movement in the backward path.

For example, as illustrated in FIG. 6A, in the forward path, the first cleaning member 411A is brought into the contact state, the water content of the second cleaning member 411B is reduced, and the ejection surface 3A is cleaned. As illustrated in FIG. 6B, in the backward path, the first cleaning member 411A is brought into the non-contact state, and the second cleaning member 411B remains in the state in the forward path.

With this operation, when the cleaning members 411 are returned to positions before cleaning in the backward path, it is possible to prevent the first cleaning member 411A having a large water content from touching the ejection surface 3A while the ejection surface 3A is wiped by the second cleaning member 411B having the reduced water content.

When the first cleaning member 411A having a sufficient water content is brought into contact with the ejection surface 3A, the ink droplets on the ejection surface 3A can be sufficiently absorbed in the forward path, but there is a possibility that the absorbed ink droplets may be ejected to the ejection surface 3A when the first cleaning member 411A comes into contact with the ejection surface 3A again at the time of returning to the original position in the backward path.

However, with the operation as described above, it is possible to prevent the movement in the backward path from causing the ink droplets absorbed by the first cleaning member 411A to be ejected to the ejection surface 3A. In addition, since the second cleaning member 411B having the reduced water content wipes the ejection surface 3A twice, it is possible to further reduce unwiped portions of the ejection surface 3A.

Figure 7:
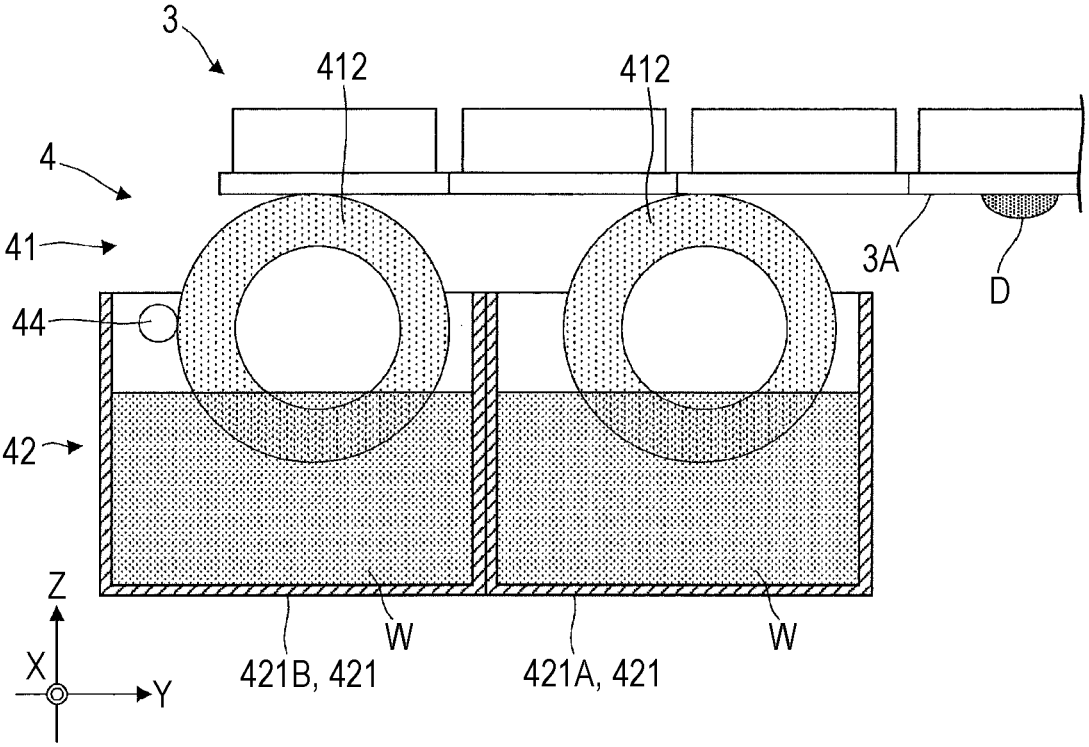
FIG. 7 is a diagram illustrating a configuration of the cleaning device in which each of the cleaning members includes a roller member.

In addition, in the above embodiment, each of the cleaning members 411 includes the blade member, but the present invention is not limited thereto, and each of the cleaning members 411 may include a roller member 42, for example, as illustrated in FIG. 7.

The roller member 412 (cleaning member) in this configuration has a surface layer formed of an elastic member capable of absorbing liquid. An adjuster 44 includes, for example, a shaft member that is contactable with the surface layer of the roller member 412. The adjuster 44 is configured to be movable forward and backward with respect to the surface layer, and can adjust the water content of the roller member 412 by sandwiching the surface layer with a shaft of the roller member 412.

In such a configuration, each of the cleaning members includes the roller member 412, and thus, the movement of the cleaning members with respect to the ejection surface 3A can be made smooth. Furthermore, since rotation of the roller member 412 makes it possible to clean a wiped portion of the ejection surface 3A with the wetting liquid W, the cleaning performance of the cleaning device 4 can be improved.

Figure 8:
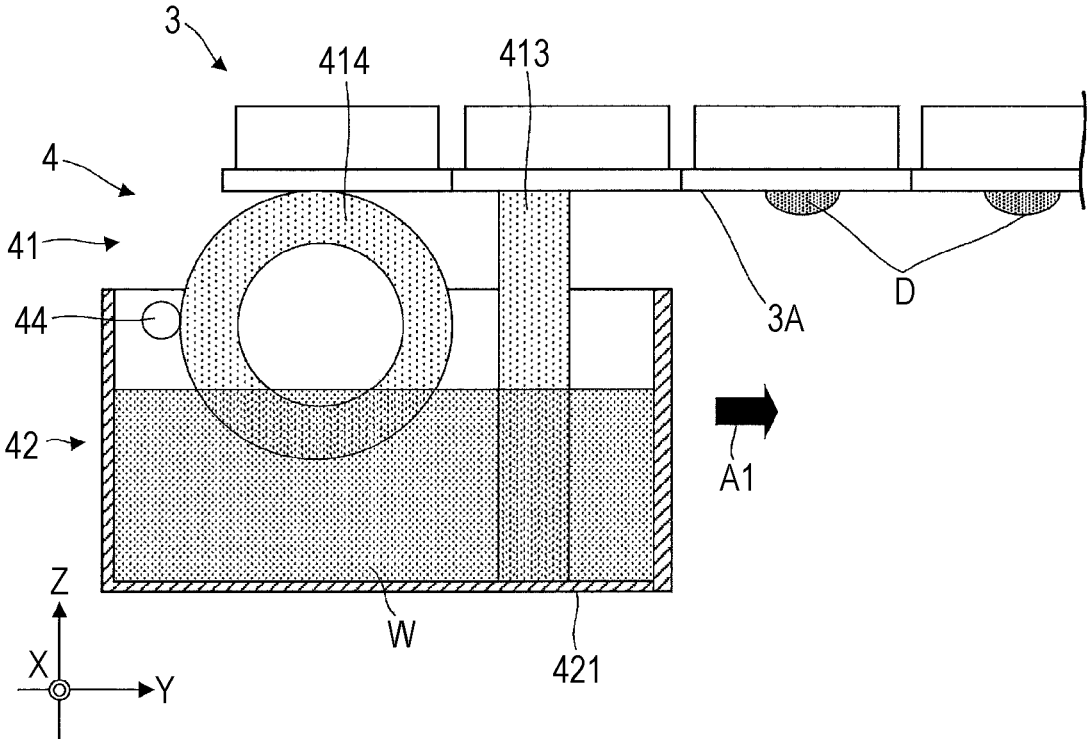
FIG. 8 is a diagram illustrating a configuration of the cleaning device in which the cleaning members include a blade member and the roller member.

As illustrated in FIG. 8, the plurality of cleaning members may be configured by combining a blade member 413 and a roller member 414. In this configuration, the blade member 413 is provided on the upstream side in the moving direction (see an arrow A1), and the roller member 414 is provided on the downstream side in the moving direction.

In this configuration, the storage 421 is configured to immerse all of the two cleaning members. That is, the storage 421 has ore region in which all of the plurality of cleaning members can be immersed in the wetting liquid W. With such a configuration, it is not necessary to divide the region for the cleaning members, and thus, the configuration can be simplified.

In the above embodiment, supply and discharge of the wetting liquid W in the storage 421 are not mentioned, but a configuration may be employed in which the wetting liquid W in the storage 421 can be supplied and discharged.

Figure 9:
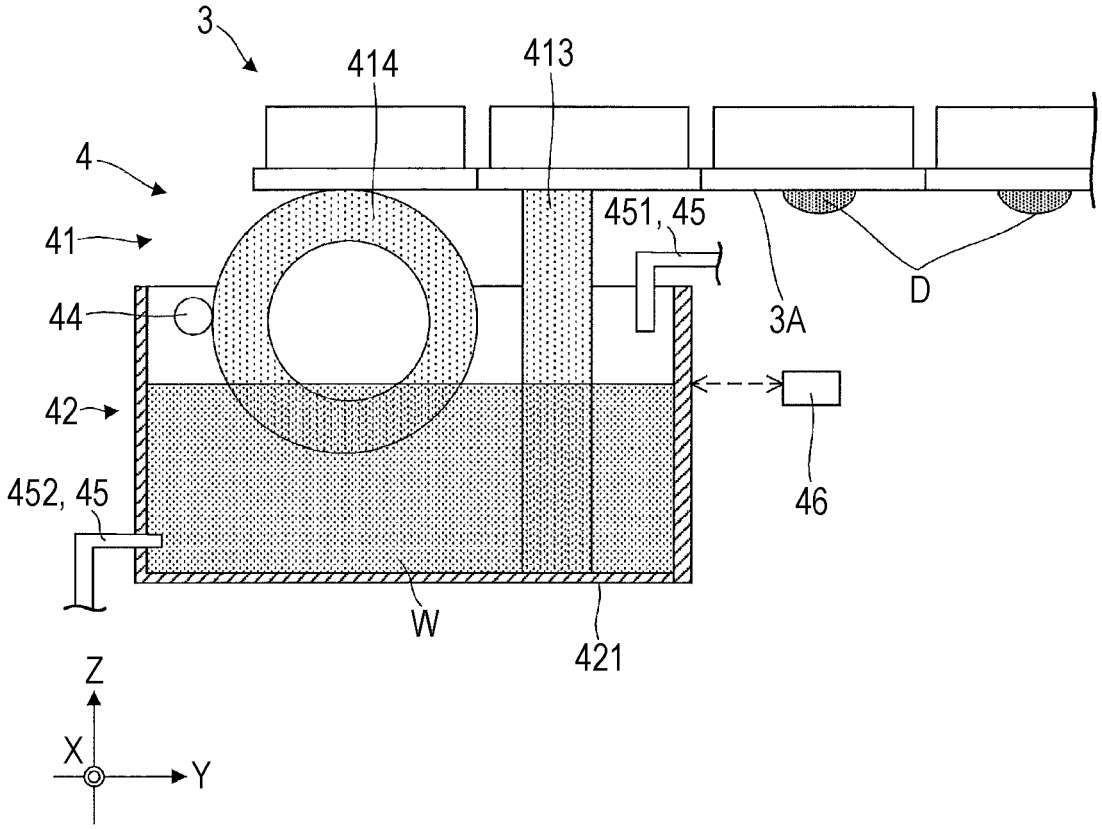
FIG. 9 is a diagram illustrating a configuration of the cleaning device provided with a supply and discharge unit.

For example, the cleaning device 4 illustrated in FIG. 9 includes a supply and discharge unit 45 and a liquid amount detector 46. The supply and discharge unit 45 includes a supply unit 451 and a discharge unit 452. The supply unit 451 is connected to a tank (not illustrated) or the like that stores the wetting liquid W. and supplies the wetting liquid W to the storage 421 under the control of the controller 100, for example.

The discharge unit 452 communicates with the inside of the storage 421, and discharges the wetting liquid W in the storage 421 by opening a valve (not illustrated) or the like under the control of the controller 100, for example.

The liquid amount detector 46 is a sensor that detects a liquid amount of the wetting liquid W in the storage 421, and is provided at an appropriate position in the cleaning device 4. The liquid amount detector 46 may be capable of detecting a liquid level by laser detection, float sensor detection, or the like, or may be capable of detecting the weight of the storage 421 by liquid capacity detection or the like.

The supply and discharge unit 45 (the supply unit 451) supplies the wetting liquid W, for example, such that the liquid amount in the storage 421 becomes a suitable amount based on a detection result of the liquid amount detector 46 under the control of the controller 100. The suitable amount is an amount that enables the cleaning members 411 to be brought into the wet state to an extent necessary for cleaning the ejection surface 3A, and is set to an appropriate amount.

For example, when the liquid amount in the storage 421 does not reach the suitable amount according to the detection result of the liquid amount detector 46, the controller 100 controls the supply unit 451 such that the liquid amount in the storage 421 becomes the suitable amount. With this operation, the amount of the wetting liquid W in the storage 421 can be maintained at the suitable amount.

Furthermore, the controller 100 determines whether the cleaning device 4 is in an error state according to a time for which the supply unit 451 supplies the wetting liquid W based on the detection result of the liquid amount detector 46. For example, if the liquid amount (the detection result of the liquid amount detector 46) does not reach the suitable amount even when the time for which the wetting liquid W is supplied reaches a predetermined time (for example, 60 seconds), the controller 100 determines that the cleaning device 4 is in the error state.

When determining that the cleaning device 4 is in the error state, for example, the controller 100 outputs a notification command for making a notification of the error state to the notifier 150 or the like of the image forming apparatus 1. In this case, the notifier 150 notifies the user that the cleaning device 4 is in the error state.

As a result, the user can quickly grasp that some kind of problem has occurred around the storage 421.

In addition, the controller 100 controls the discharge unit 452 to discharge the wetting liquid W in the storage 421 according to the state of cleaning by the plurality of cleaning members 411. For example, when the plurality of cleaning members 411 perform cleaning a predetermined number of times (for example, five times) or more, it is considered that the ink droplets wiped off by the cleaning members 411 get the wetting liquid W dirty to some extent.

Therefore, in this case, the controller 100 discharges the wetting liquid W in the storage 421. After discharging the wetting liquid W, the controller 100 controls the supply unit 451 to supply the wetting liquid W to the storage 421.

With this operation, the wetting liquid W stored in the storage 421 can be maintained in a suitable state. Note that the determination of the state of cleaning may be performed based on the number of times of cleaning as described above, or may be performed based on a detection result of a sensor that detects a liquid concentration or a liquid permeability. The number of times of cleaning (predetermined number of times) can be appropriately set according to the scale of the image forming apparatus 1 or the size of the recording head 3.

Figure 10:
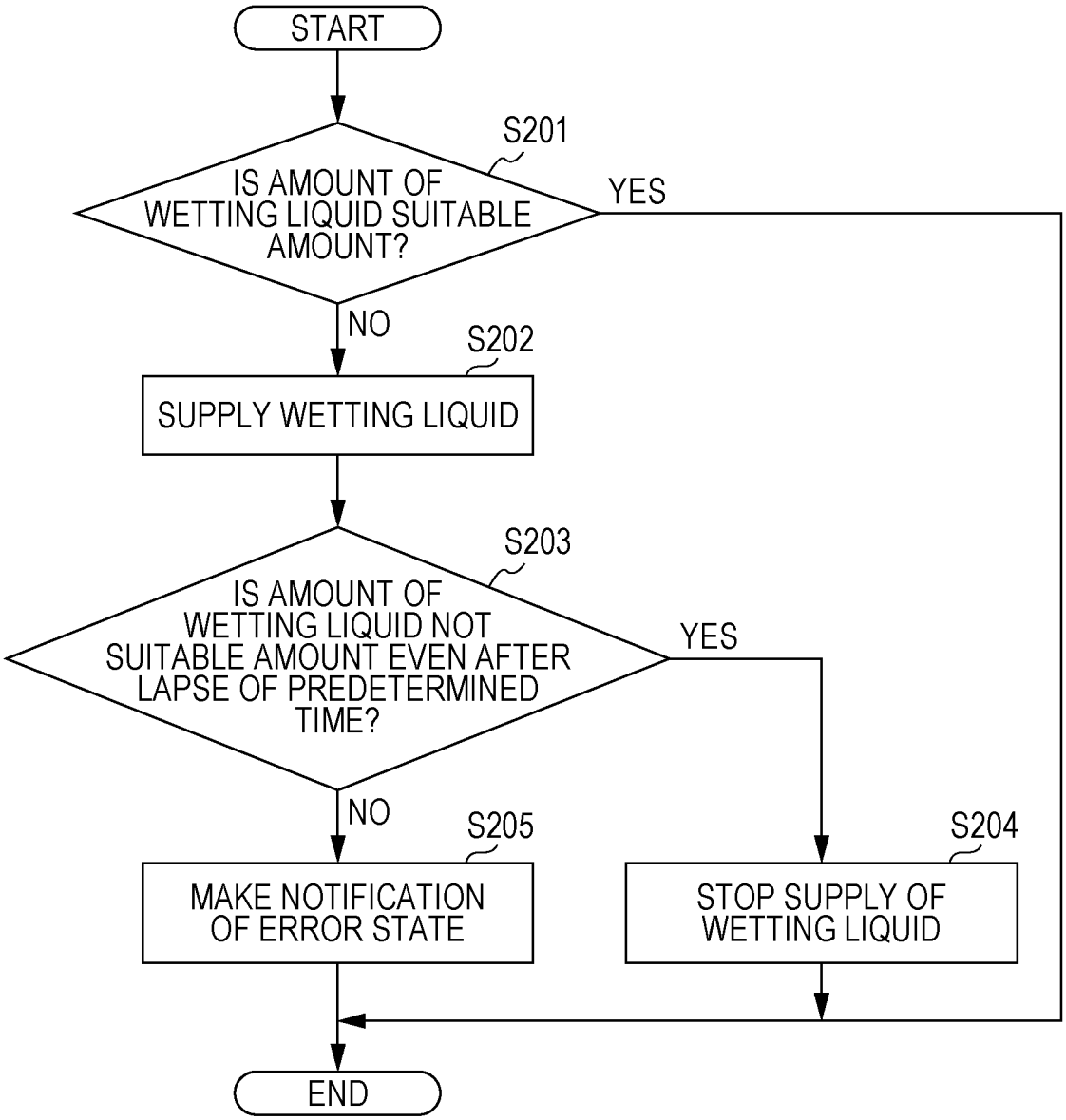
FIG. 10 is a flowchart illustrating an operation example of supply control of wetting liquid in the image forming apparatus.

An operation example of supply control of the wetting liquid W in the cleaning device 4 in the image forming apparatus 1 including the supply and discharge unit 45 will be described. FIG. 10 is a flowchart illustrating the operation example of the supply control of the wetting liquid W in the image forming apparatus 1. The processing in FIG. 10 is appropriately executed, for example, when the image forming apparatus 1 receives the execution command of the cleaning control.

As illustrated in FIG. 10, the controller 100 determines whether the amount of the wetting liquid W is the suitable amount (step S201). As a result of the determination, if the amount of the wetting liquid W is the suitable amount (YES in step S201), this control ends.

On the other hand, if the amount of the wetting liquid W is not the suitable amount (NO in step S201), the controller 100 controls the supply unit 451 to supply the wetting liquid W (step S202). Next, the controller 100 determines whether the amount of the wetting liquid W is not the suitable amount even after a lapse of the predetermined time from a start of supply of the wetting liquid W (step S203).

As a result of the determination, if the amount of the wetting liquid W is the suitable amount after the lapse of the predetermined time (YES in step S203), the controller 100 stops the supply of the wetting liquid W (step S204). On the other hand, if the amount of the wetting liquid W is not the suitable amount after the lapse of the predetermined time (NO in step S203), the controller 100 stops the supply of the wetting liquid W and notifies the user that the cleaning device 4 is in the error state (step S205). After step S204 or step S205, this control ends.

Next, an operation example of discharge control of the wetting liquid W in the cleaning device 4 in the image forming apparatus 1 including the supply and discharge unit 45 will be described. FIG. 1 is a flowchart illustrating the operation example of the discharge control of the wetting liquid W in the image forming apparatus 1. The processing in FIG. 11 is appropriately executed, for example, when the image forming apparatus 1 receives the execution command of the cleaning control.

Figure 11:
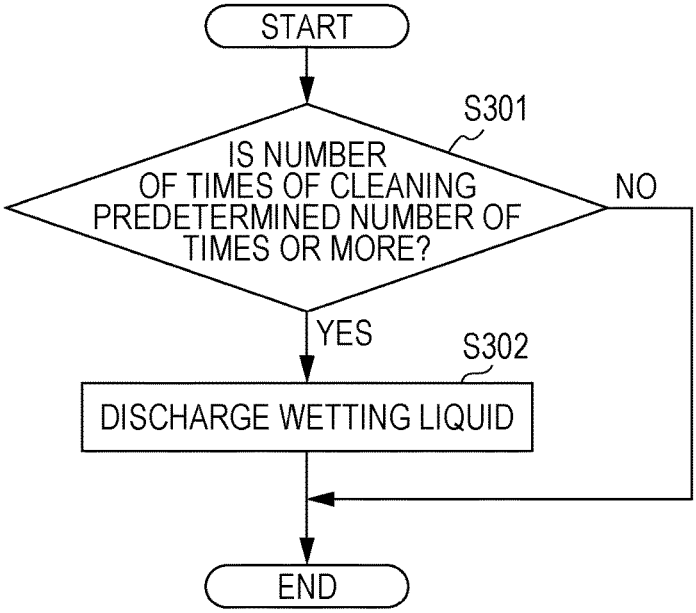
FIG. 11 is a flowchart illustrating an operation example of discharge control of the wetting liquid in the image forming apparatus.

As illustrated in FIG. 11, the controller 100 determines whether the number of times of cleaning by the cleaning device 4 is the predetermined number of times or more (step S301). As a result of the determination, if the number of times of cleaning is less than the predetermined number of times (NO in step S301), this control ends.

On the other hand, if the number of times of cleaning is the predetermined number of times or more (YES in step S301), the controller 100 controls the discharge unit 452 to discharge the wetting liquid W (step S302). After step S302, this control ends. Note that, after this control ends, the control according to the flowchart illustrated in FIG. 10 is executed.

In addition, in the above embodiment, two cleaning members are provided, but the present invention is not limited thereto, and three or more cleaning members may be provided.

Furthermore, in the above embodiment, the cleaning members are always immersed in the wetting liquid in the storage, but the present invention is not limited thereto, and the cleaning members do not have to be always immersed in the wetting liquid in the storage as long as the cleaning members are in the wet state at the time of cleaning.

Furthermore, in the above embodiment, the cleaning members are brought into the wet state by being immersed in the wetting liquid in the storage, but the present invention is not limited thereto, and for example, the cleaning members may be brought into the wet state by another fixing preventer such as a device capable of applying the wetting liquid.

Furthermore, in the above embodiment, the adjuster is provided, but the present invention is not limited thereto, and the adjuster does not have to be provided.

Next, a verification experiment of the cleaning device 4 according to the present embodiment will be described. In the verification experiment, the image forming apparatus 1 illustrated in FIG. 1 was used, and a dye ink (aqueous ink) was used as ink. The cleaning device 4 included the cleaner including the blade member and the roller member, for example, as in the configuration illustrated in FIG. 8. Regarding cleaning conditions, the moving speed of the cleaning device 4 was 50 mm/s, the rotation speed of the roller member was 50 mm/s, the pushing amount of the adjuster was 1 mm, and the wetting liquid was pure water.

In this verification experiment, it was confirmed whether the ejection surface was damaged in cleaning after a purge was performed. Ina comparative example, as in the configuration described in JP 2020-82687 A, the cleaning members were not always immersed in the wetting liquid.

Figure 12:
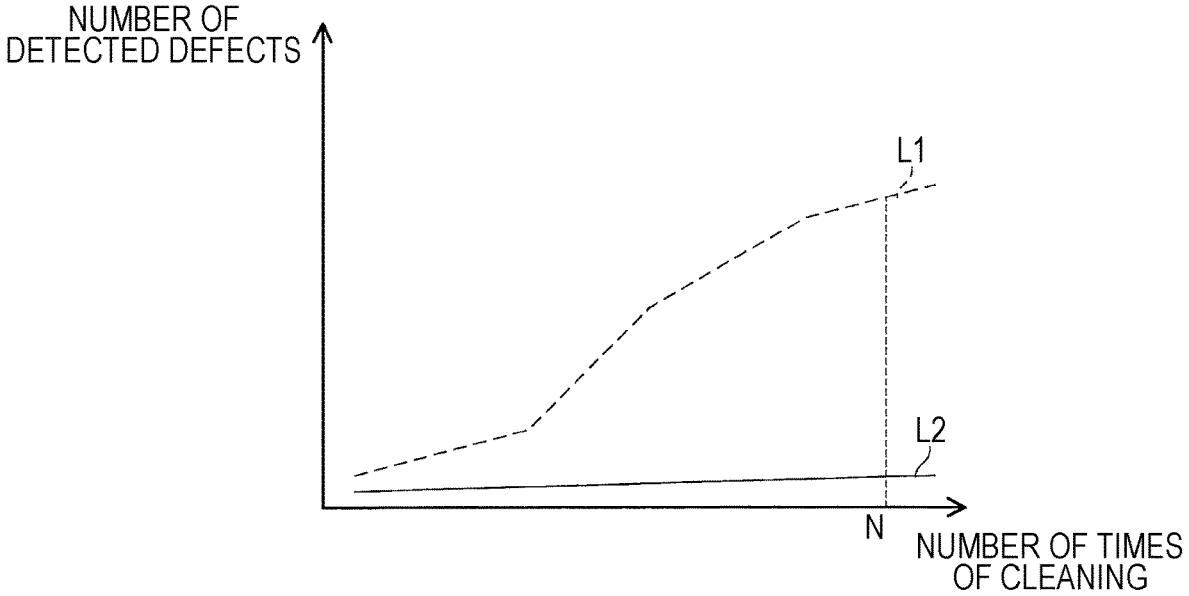
FIG. 12 is a diagram illustrating experimental results of a verification experiment according to the present embodiment.

As illustrated in FIG. 12, in the configuration of the comparitive example, it was confirmed that defects caused by the damage on the ejection surface were detected at a relatively high frequency as the number of times of cleaning increased (see a broken line L1). Specifically, as many as several hundred or more defects were detected when the number of times of cleaning was N (about 500 times).

On the other hand, in the present embodiment, less than 20 defects were detected when the number of times of cleaning was N, and it was confirmed that the number of detected defects was significantly reduced as compared with the comparative example (see a solid line L2). That is, in the present embodiment, it was confirmed that the ejection surface could be prevented from being damaged due to the fixing of the absorbed matter, and eventually, the cleaning performance of the cleaning device could be improved.

In addition, the above embodiment and modifications are merely examples of implementation in carrying out the present invention, and the technical scope of the present invention should not be interpreted in a limited manner by the embodiment and modifications. That is, the present invention can be carried out in various forms without departing from its gist or its main features.

Although embodiments of the present invention have been described and illustrated in detail, the disclosed embodiments are made for purposes of illustration and example only and not limitation. The scope of the present invention should be interpreted by terms of the appended claims.

What is claimed is:

1. A cleaning device comprising a plurality of cleaning members that come into contact with and clean an ejection surface of a droplet ejector that ejects droplets; and a fixing preventer that prevents matter absorbed from the ejection surface by the plurality of cleaning members from being fixed in the plurality of cleaning members, wherein the plurality of cleaning members are in a wet state, and each of the plurality of cleaning members includes a member capable of absorbing liquid.

2. The cleaning device according to claim 1, wherein the fixing preventer brings the plurality of cleaning members into the wet state at least when the cleaning device cleans the ejection surface.

3. The cleaning device according to claim 1, wherein the plurality of cleaning members are arranged side by side in a predetermined direction, and are relatively movable with respect to the ejection surface in the predetermined direction.

4. The cleaning device according to claim 3, further comprising an adjuster that adjusts a water content of at least a part of the plurality of cleaning members in the wet state, wherein the adjuster adjusts the water content of the at least a part of the plurality of cleaning members to be smaller than the water content of the at least a part of the plurality of cleaning members before adjustment.

5. The cleaning device according to claim 4, wherein the adjuster makes a water content of a downstream cleaning member positioned on a downstream side of an upstream cleaning member in a moving direction of the plurality of cleaning members smaller than a water content of the upstream cleaning member, the downstream cleaning member and the upstream cleaning member being included in the plurality of cleaning members.

6. The cleaning device according to claim 5, wherein when the plurality of cleaning members reciprocate between a forward path and a backward path in the predetermined direction, the adjuster is capable of switching a cleaning member whose water content is made smaller between the forward path and the backward path, the cleaning member being included in the plurality of cleaning members.

7. The cleaning device according to claim 3, wherein the plurality of cleaning members reciprocate between a forward path and a backward path in the predetermined direction, and at least a part of the plurality of cleaning members is capable of transitioning between a contact state in which at least a part of the plurality of cleaning members is contactable with the ejection surface and a non-contact state in which at least a part of the plurality of cleaning members is not contactable with the ejection surface, and is capable of being switched between the contact state and the non-contact state according to a movement in the forward path and a movement in the backward path.

8. The cleaning device according to claim 4, wherein the member capable of absorbing liquid is elastic, and each of the plurality of cleaning members includes either a blade member or a roller member.

9. The cleaning device according to claim 4, wherein the adjuster is capable of setting an adjustment amount of the water content automatically or by a user operation according to a cleaning type of the droplet ejector.

10. The cleaning device according to claim 1, wherein the fixing preventer includes a storage that stores wetting liquid, and the plurality of cleaning members are immersed in the wetting liquid in the storage to be in the wet state.

11. The cleaning device according to claim 10, wherein the storage has one region in which all of the plurality of cleaning members are capable of being immersed in the wetting liquid.

12. An image forming apparatus comprising:

a droplet ejector that ejects droplets onto a recording medium; and the cleaning device according to claim 1.

13. The image forming apparatus according to claim 12, further comprising a supply and discharge unit capable of supplying and discharging wetting liquid that brings the plurality of cleaning members into the wet state to and from a storage that stores the wetting liquid.

14. The image forming apparatus according to claim 13, further comprising:

a liquid amount detector that detects a liquid amount of the wetting liquid in the storage; and a hardware processor that controls the supply and discharge unit to supply the wetting liquid to the storage based on a detection result of the liquid amount detector such that the liquid amount in the storage becomes a suitable amount.

15. The image forming apparatus according to claim 14, further comprising a notifier that makes a notification of an error state according to a time for which the supply and discharge unit supplies the wetting liquid to the storage based on the detection result of the liquid amount detector.

16. The image forming apparatus according to claim 14, wherein the hardware processor controls the supply and discharge unit to discharge the wetting liquid in the storage according to a state of cleaning by the plurality of cleaning members.

17. The cleaning device according to claim 1, wherein the plurality of cleaning members are immersed in wetting liquid and in the wet state.

* * * * *